United States Patent [19]

Brophy

[11] Patent Number: 4,697,367

[45] Date of Patent: Oct. 6, 1987

[54] BUTTPLATE WITH SLIDING COVER FOR BUTTSTOCK STORAGE CHAMBER

[75] Inventor: William S. Brophy, Northford, Conn.

[73] Assignee: Marlin Firearms Company, North Haven, Conn.

[21] Appl. No.: 863,946

[22] Filed: May 16, 1986

[51] Int. Cl.[4] ..... F41C 23/00

[52] U.S. Cl. ..... 42/71.01

[58] Field of Search ..... 42/71.01

[56] References Cited

U.S. PATENT DOCUMENTS 404,921 6/1889 Miller ..... 42/71.01

746,859 12/1903 Marble ..... 42/71.01 X 939,707 11/1909 Kennedy ..... 42/71.01

1,517,420 12/1924 Fritz ..... 42/71.01

*Primary Examiner*—Deborah L. Kyle

*Assistant Examiner*—Ted L. Parr

*Attorney, Agent, or Firm*—Joseph J. Baker

[57] ABSTRACT

A buttplate is disclosed for a firearm buttstock of the type having a chamber therein for storing cartridges and the like. The buttplate has a plate member with an opening to permit access to the chamber and a channel in communication with the opening for receiving a removable cover member. The cover member is slidable in the channel over the opening to control access to the chamber and has means to maintain it in the channel across the opening.

8 Claims, 8 Drawing Figures

BUTTPLATE WITH SLIDING COVER FOR BUTTSTOCK STORAGE CHAMBER

BACKGROUND OF THE INVENTION

This invention relates to firearm buttstocks of the type having a chamber in the end thereof for storing articles and more particularly to a buttplate for the buttstock having a cover member slidable in the buttplate to control access to the chamber.

Buttplates for firearm buttstocks having cover members associated therewith to control access to a storage chamber in the end of the buttstock are not new. U.S. Pat. Nos. 746,859 and 939,707 are typical of the prior art and have cover members which are attached and pivotable relative to the buttplate and require separate means to maintain the cover member in its closed position which necessarily complicates its construction and raises the cost to manufacture and assemble it.

In contrast, applicant's buttplate has a cover member which is slidable within the buttplate and is made of a material which enables arms, integrally formed on the cover member, to be resiliently biased into engagement with corresponding notches formed in the buttplate to hole the cover member over an access opening in the buttplate.

It is therefore the primary object of my invention to provide a superior buttplate for a firearm buttstock of the type having a storage chamber formed in an end thereof.

It is another object of my invention to provide a buttplate having a slidable cover member for controlling access to a storage chamber for articles in the buttstock.

It is a further object of my invention to provide a buttplate with a cover member having integrally formed locking means for maintaining it in position within the buttplate.

It is yet another object of my invention to provide a buttplate of the subject type which is simple in construction, reliable in operation and relatively inexpensive to make yet is capable of protecting the contents of the chamber against loss and the wooded stock against damage.

With these and objects, variations, modifications and adaptations which can be readily improvised by one skilled in this art, it is my intention not to be limited by the illustrations of the preferred example of my invention as described fully hereinbelow, but to be limited solely by the basic concepts underlying the fundamental principles as defined in the hereunto appended claims.

Since nothing whatsoever pertaining to the operation of the firing mechanism is embodied or involved in any of the basic concepts underlying the fundamentals of my invention, the specification will be limited to the stock or butt portion of a firearm.

DETAILED DESCRIPTION OF THE INVENTION

Figure 1:
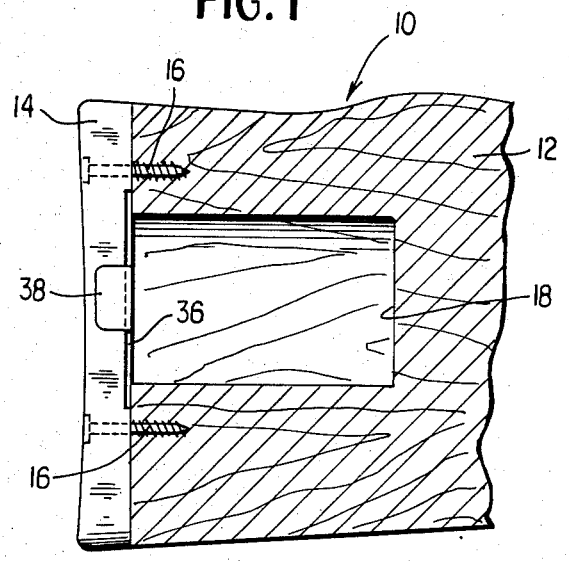
FIG. 1 is a side elevation of the end portion in cross section of a firearm buttstock with my novel buttplate attached thereto.
Figure 2:
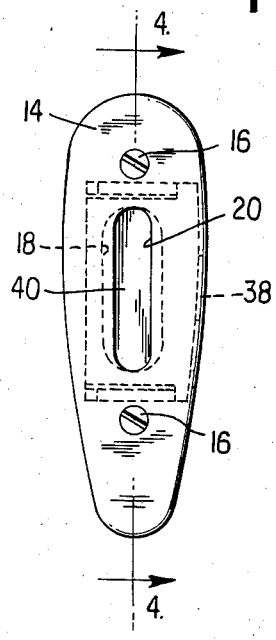
FIG. 2 is an end elevation view of the buttstock and buttplate of the present invention with the cover member in its closed position.

Referring now to the drawings where like reference numerals indicate like elements in each of the several views, numeral 10 of FIG. 1 represents the stock proper for a firearm comprising a buttstock 12 typically of wood and a heel or buttplate 14 attached thereto by means of screws 16. The buttstock 12 is of the type having a hollow chamber 18 formed in an end thereof for storing such articles as extra cartridges for the firearm, cleaning or repairing tools, matches, etc.

The buttplate 14, as can best be seen by referring to FIGS. 2–5, is made typically of moulded plastic-like material or hard rubber and has an opening or through bore 20 formed therein to provide access to the chamber 18 when the buttplate is attached to the buttstock 12 in the manner shown. The buttplate 14 has a rectangular shaped channel 22 formed on the inside surface 24 which is in communication with the opening 20. The buttplate 14 also has an aperture 26 in communication with the channel 22 and a pair of spaced-apart recesses 28 formed in the channel 22 the functions of which will be fully described later. Sufficient to say at this point that the recesses 28 each have an elongated portion 30 which leads into a cavity 32 at one end of the elongated portion.

A cover member 36 is provided for controlling access to the storage chamber 18 through opening 20. The cover member 36 is preferably formed of sheet metal material such as steel having a degree of spring-like character or it may be moulded of plastic having the same resilient characteristics. The cover member 36 has a flat rectangular-shaped central portion 40. A tab 38 is provided extending perpendicular to the plane of the central portion 40 and connected thereto to enable the cover member 36 to be operated by the hand of the user. A pair of elongated, spaced-apart locking arms 42 are integrally formed with or otherwise connected to opposite ends of the sheet material 40 and each has a projection 44 extending away from the locking arms 42 in the same direction as the tab 38. The locking arms 42 and projections 44 extend out of the plane of the central portion 40 and, due to the resilience of the sheet material, the locking arms 42 will return to these original aforementioned extended positions after being forced back into the plane of the sheet material and released.

Figure 3:
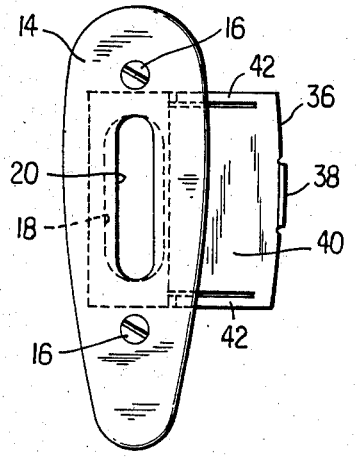
FIG. 3 is an end elevation view of the buttstock with the cover member in its open position.
Figure 4:
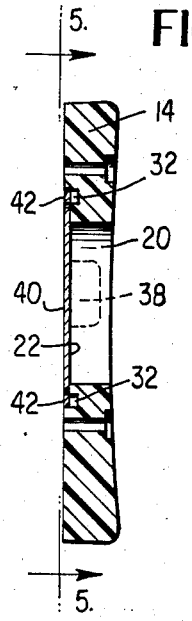
FIG. 4 is a cross-sectional view of the buttplate taken along the lines 4—4 of FIG. 2.
Figure 5:
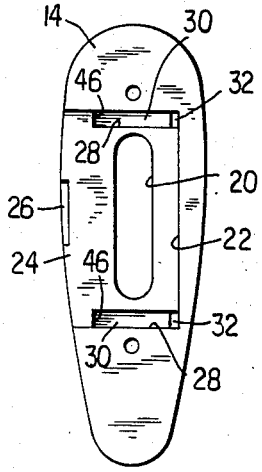
FIG. 5 is a side view of the buttplate taken along the lines 5—5 of FIG. 4.
Figure 6:
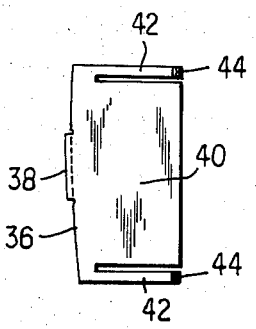
FIG. 6 is a plan view of the cover member for the buttplate of the present invention.
Figure 7:
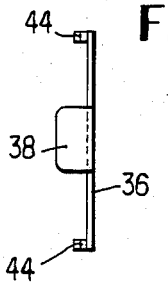
FIG. 7 is a side view of the cover plate of FIG. 6.
Figure 8:
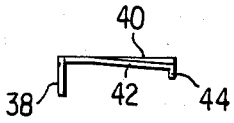
FIG. 8 is an end view of the coveplate of FIG. 6.

When the cover member 36 is installed in channel 22 of buttplate 14 such that there is access through opening 20 into the storage chamber 18, the projections 44 will engage the end walls 46 of the recesses 28 to prevent removal of the cover member 36 from the channel 22. As the cover member 36 is slid by the user from right to left as viewed in FIG. 2 by engaging tab 38, the opening 20 is closed by the cover member 36. When the cover member 36 is moved so that it fully occupies channel 22, the tab 38 will be in aperture 26 so as not to impair the usefulness and utility of the firearm while it is in use, and the projections 44 will be resiliently biased into cavities 32 to thereby lock the cover member 36 in the channel 22. Movement of the tab 38 out of aperture 26 as shown in FIG. 3 will cause the projections 44 to move out of the cavities 32 and the locking arms 42 move toward the plane of the central portion 40. After the cover member 36 is withdrawn from across the opening 20, articles such as extra cartridges, matches, etc. can be inserted into or removed from the chamber 18.

Many changes and modifications in the above-described embodiment of the invention can, of course, be carried out without departing from the scope thereof. Accordingly, that scope is intended to be limited only by the scope of the appended claims.

What is claimed is:

1. A buttplate for a firearm buttstock of the type having a storage chamber formed therein for the storage of articles, said buttplate comprising:

(a) a plate member having an opening therethrough to permit access to said chamber when said plate member is attached to said buttstock and a channel formed in said plate member in communication with said opening;

(b) a cover member slidable in said channel from a first position which permits access to said chamber through said opening to a second position which prevents access to said chamber through said opening, and (c) locking means comprising at least one locking arm connected to said cover member, said locking arm being engageable with detent means on said plate member to maintain said cover member in said second position.

2. A buttplate as set forth in claim 1 wherein said locking arm has a projection on the end thereof and said channel has at least one recess formed in said channel for receiving said projection when said cover member is in its second position to hold said cover member in said channel.

3. A buttplate as set forth in claim 2 wherein said cover member has tab means manually engagable to move said cover member and said plate member has an aperture formed therein to receive said tab means when said cover means is in its second position.

4. A buttplate as set forth in claim 2 wherein said cover member has a substantially flat upper surface portion with spaced-apart locking arms connected at one end thereof at opposite ends of said upper surface portions and the free ends of said arms extending above said upper surface portion.

5. In combination with a firearm buttstock of the type having a storage chamber formed in the end thereof, a buttplate comprising:

(a) a plate member having an opening therethrough to permit access with said chamber when said plate member is attached to said buttstock, and a channel formed in said plate member in communication with said opening, (b) a cover member slidable in said channel from a first position wherein objects can be inserted into or removed from said chamber through said opening to a second position across said aperture to eliminate access to said chamber through said opening, and (c) locking means comprising at least one locking arm connected to said cover member, said locking arm being engageable with detent means on said plate member to maintain said cover member in said second position.

6. A combination as set forth in claim 5 wherein said locking arm has a projection on the end thereof and said channel has at least one recess formed in said channel for receiving said projection when said cover member is in its second position to hold said cover member in said channel.

7. A combination as set forth in claim 6 wherein said cover member has tab means manually engagable to move said cover member and said plate member has an aperture formed therein to receive said tab means when said cover means is in its second position.

8. A combination as set forth in claim 6 wherein said cover member has a substantially flat upper surface portion with spaced-apart locking arms connected at one end thereof at opposite ends of said upper surface portion, the free ends of said arms extending above said upper surface portion.

* * * * *